US005890498A

United States Patent [19]

Kawaguchi

[11] Patent Number: 5,890,498

[45] Date of Patent: Apr. 6, 1999

[54] HAIRPIECE TOY

[75] Inventor: Hiroshi Kawaguchi, Osaka, Japan

[73] Assignee: Kawaguchi Co., Ltd., Habikino, Japan

[21] Appl. No.: 869,775

[22] Filed: Jun. 5, 1997

[30] Foreign Application Priority Data

Jun. 7, 1996 [JP] Japan ..... 8-005213

[51] Int. Cl.[6] ..... A45D 8/24

[52] U.S. Cl. ..... 132/275; 132/278

[58] Field of Search ..... 132/275, 278, 132/281, 201, 105, 53, 54, 55, 56, 279, 277; 63/20

[56] References Cited

U.S. PATENT DOCUMENTS

| | | | |
|---|---|---|---|
| 193,304 | 7/1877 | Wells | 132/54 |
| 401,649 | 4/1889 | Hackett | 132/275 |
| 1,525,051 | 2/1925 | Smith | 132/279 |
| 2,488,954 | 11/1949 | Winters | 132/275 |
| 2,651,310 | 9/1953 | Selson | 132/53 |
| 3,082,773 | 3/1963 | Renstrom et al. | 132/278 |
| 3,550,161 | 12/1970 | Orozco | 132/53 |
| 4,406,296 | 9/1983 | Wexler et al. | 132/53 |
| 4,830,029 | 5/1989 | Bird | 132/53 |
| 5,303,724 | 4/1994 | Anzivino | 132/275 |
| 5,501,239 | 3/1996 | Walker | 132/275 |
| 5,658,150 | 8/1997 | Moreau | 434/156 |

FOREIGN PATENT DOCUMENTS

| | | | |
|---|---|---|---|
| 421964 | 10/1910 | France | 132/105 |
| 362668 | 8/1962 | Switzerland | 132/105 |

*Primary Examiner*—Todd E. Manahan
*Assistant Examiner*—Eduardo C. Robert
*Attorney, Agent, or Firm*—Oblon, Spivak, McClelland, Maier & Neustadt, P.C.

[57] ABSTRACT

A hairpiece toy which allows children to easily ornament their own hair therewith includes a braid ornament hair portion having a braid of artificial hairs sewn on a surface of a backing cloth with a clip sewn on the reverse face thereof, and a ribbon ornament portion having a ribbon formed in a butterfly-shaped configuration and sewn on the surface of the backing cloth.

10 Claims, 12 Drawing Sheets

HAIRPIECE TOY

BACKGROUND OF THE INVENTION

1. Field of the Invention

The present invention relates to a hairpiece toy for adornment of child's hair.

2. Description of the Background Art

For attractive adornment of child's hair, it has been common to braid child's hair or to tie child's hair with a rubber band with an ornament.

However, person's hair is mostly in a position difficult to view with his or her own eyes, and a person must have considerable skills to arrange such hair into a uniformly fixed braid. It is, therefore, not easy for small children to attach such ornaments to their hair.

SUMMARY OF THE INVENTION

The present invention is directed to a hairpiece toy. According to a first aspect of the present invention, the hairpiece toy comprises: a fastening for attachment to and removal from hair, and an ornament hair portion including ornamentally processed artificial hairs, the fastening and the ornament hair portion being integrally connected together.

Preferably, according to a second aspect of the present invention, the hairpiece toy further comprises a ribbon ornament portion attached to the ornament hair portion.

Preferably, according to a third aspect of the present invention, the ribbon ornament portion includes a ribbon formed in a butterfly-shaped configuration.

Preferably, according to a fourth aspect of the present invention, the ribbon ornament portion is positioned to cover the fastening.

Preferably, according to a fifth aspect of the present invention, the hairpiece toy further comprises a formed ornament portion having a surface with an ornamental pattern and attached to the ornament hair portion.

Preferably, according to a sixth aspect of the present invention, the fastening is a clip.

Preferably, according to a seventh aspect of the present invention, the fastening is a barrette.

Preferably, according to an eighth aspect of the present invention, the ornament hair portion comprises a braid of artificial hairs.

Preferably, according to a ninth aspect of the present invention, the ornament hair portion comprises a braid of artificial hairs formed in a doughnut-shaped configuration.

Preferably, according to a tenth aspect of the present invention, the ornament hair portion comprises a curled tuft of artificial hairs.

In accordance with the first aspect of the present invention, child's hair may be readily ornamented only by attaching the fastening to the child's hair.

In accordance with the second, third and fifth aspects of the present invention, the ribbon ornament portion and the formed ornament portion may be attached to and removed from hair at the same time that the ornament hair portion is attached and removed. This provides improved ornamentation.

In accordance with the fourth aspect of the present invention, the ribbon ornament portion positioned to cover the fastening allows an inconspicuous boundary between human hair and the hairpiece toy.

In accordance with the eighth, ninth, and tenth aspects of the present invention, the braid of artificial hairs, the braid of artificial hairs formed in the doughnut-shaped configuration, and the curled tuft of artificial hairs allow more complex and beautiful ornamentation without difficulty.

It is therefore an object of the present invention to provide a hairpiece toy which permits children to easily ornament their own hair therewith.

These and other objects, features, aspects and advantages of the present invention will become more apparent from the following detailed description of the present invention when taken in conjunction with the accompanying drawings.

DESCRIPTION OF THE PREFERRED EMBODIMENTS

A hairpiece toy will now be described according to preferred embodiments of the present invention.

Figure 1:
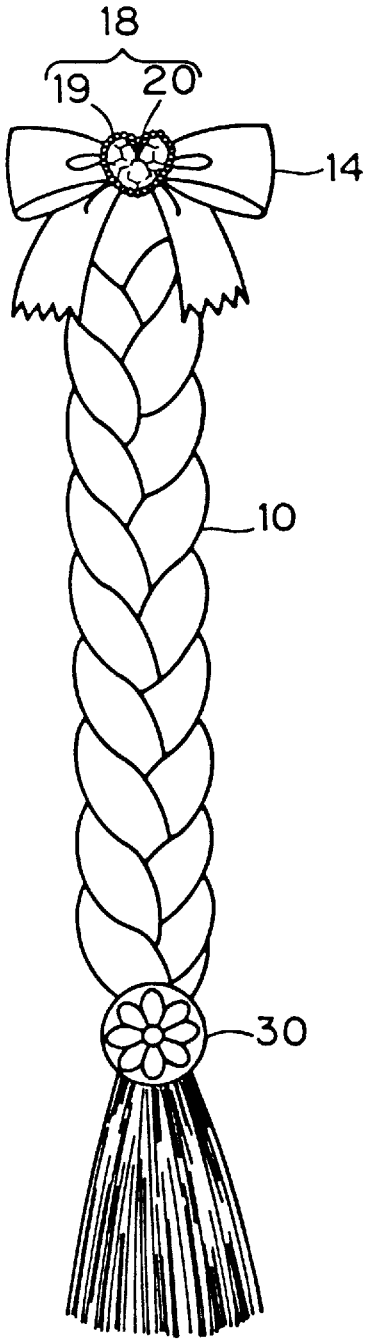
FIG. 1 is a front elevation of a hairpiece toy according to a first preferred embodiment of the present invention.
Figure 2:
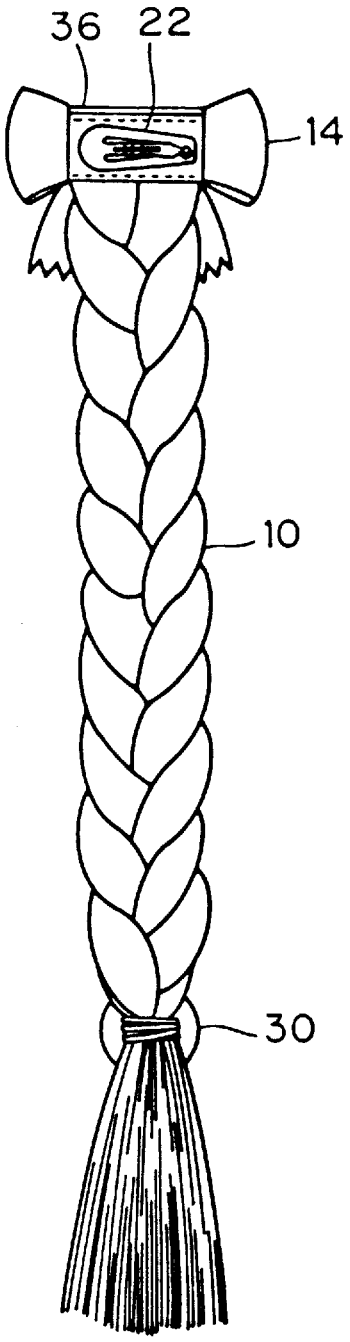
FIG. 2 is a rear elevation of the hairpiece toy according to the first preferred embodiment.

With reference to FIGS. 1 and 2, the hairpiece toy according to a first preferred embodiment of the present invention comprises a braid ornament hair portion 10 including braided artificial hairs, a ribbon ornament portion 14 and a heart-shaped ornament portion 18 attached to an upper front part of the braid ornament hair portion 10, a hair clip 22 known as and referred to hereinafter simply as a clip 22 attached to an upper rear part of the braid ornament hair portion 10, and a floral pattern ornament portion 30 attached to a lower front part of the braid ornament hair portion 10.

Figure 3:
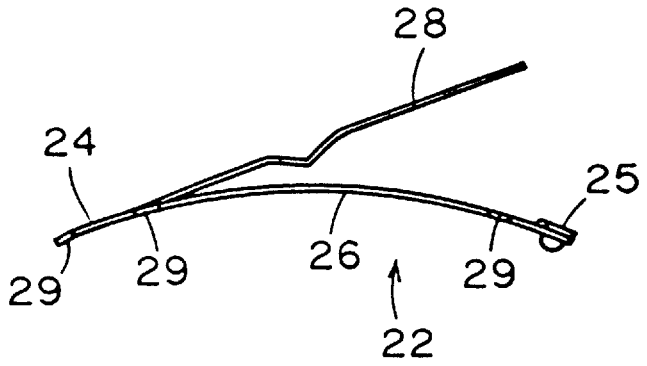
FIG. 3 is a side view of a clip.
Figure 4:
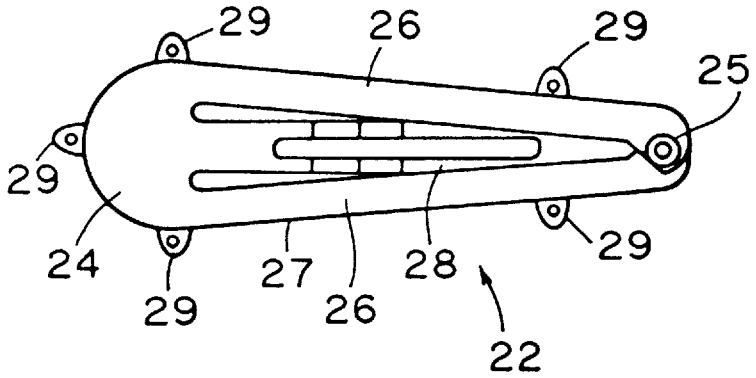
FIG. 4 is a bottom view of the clip.

The clip 22 which is a known hair clip for clipping hair comprises a frame element 27 including a pair of side portions 26 extending in parallel in the same direction from a base portion 24 and coupled together at their forward ends through a pin 25, and an elastic piece 28 extending from the base portion 24 between the pair of side portions 26, as illustrated in FIGS. 3 and 4.

As the frame element 27 is curved toward one face thereof, the elastic piece 28 is placed into an open position wherein the elastic piece 28 is angled with respect to the frame element 27. With the elastic piece 28 in its open position, a tuft of human hair is inserted between the frame element 27 and the elastic piece 28. Thereafter, as the frame element 27 is curved toward the other face thereof, the elastic piece 28 is pressed and urged against the frame element 27 into a closed position. The clip 22 is then attached to the human hair. On the other hand, the clip 22 may be removed from the human hair as the frame element 27 is curved toward the one face thereof to place the elastic piece 28 into the open position wherein the elastic piece 28 is angled with respect to the frame element 27.

A plurality of hole portions 29 for sewing are formed on the periphery of the frame element 27 of the clip 22. The three-pin 22 is sewn on the back side of a backing cloth 36 through the plurality of hole portions 29.

The braid ornament hair portion 10 is formed by plaiting three tufts of artificial hairs into a braid. An upper part of the braid ornament hair portion 10 is sewn on the front side of the backing cloth 36.

Figure 5:
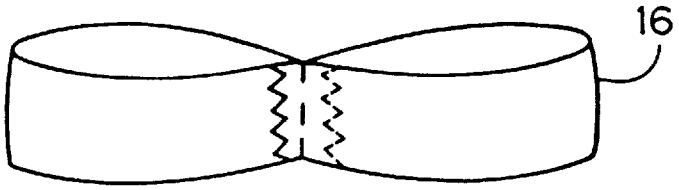
FIGS. 5 and 6 illustrate a ribbon ornament portion.
Figure 6:
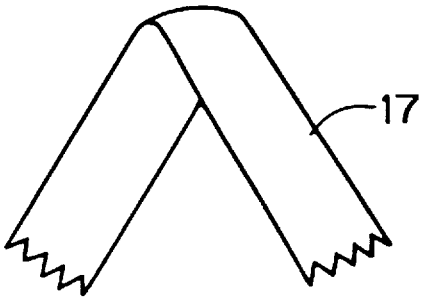
Figure 7:
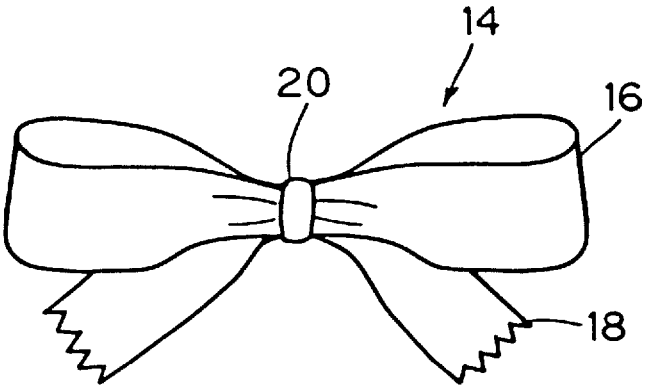
FIG. 7 is a front elevation of the ribbon ornament portion.

The ribbon ornament portion 14, as illustrated in FIGS. 5 through 7, includes a twin ring-shaped portion 16 formed by sewing a ring-shaped ribbon of satin at circumferentially opposed positions together, a V-shaped portion 17 formed by folding back a ribbon of satin having saw-toothed opposite ends into a generally V-shaped configuration, the V-shaped portion 17 being sewn at its folded position on a middle sewing part of the twin ring-shaped portion 16, and a narrow band 20 wound around the sewn parts of the twin ring-shaped portion 16 and the V-shaped portion 17 in such a manner as to tie the twin ring-shaped portion 16 and the V-shaped portion 17 together.

The ribbon ornament portion 14 is sewn on the backing cloth 36 on which the braid ornament hair portion 10 is sewn.

The heart-shaped ornament portion 18 is sewn on the front side of the ribbon ornament portion 14, and includes a gold-colored plated base portion 19 and a heart-shaped colored imitation jewel 20 rigidly secured to the base portion 19.

Figure 8:
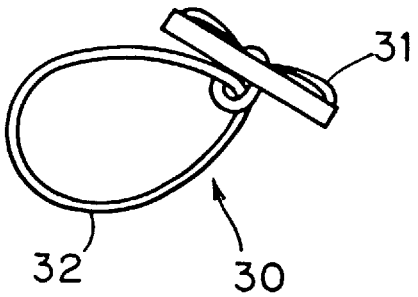
FIG. 8 illustrates a floral pattern ornament portion.

The floral pattern ornament portion 30, as illustrated in FIG. 8, includes a formed portion 31 having a surface embossed with a floral design, and a colored rubber band 32 for attachment to hair. The colored rubber band 32 is wound around a lower part of the braid ornament hair portion 10 so as to tie the lower part thereof together. Then, the colored rubber band 32 is attached to the lower part of the braid ornament hair portion 10.

The single hairpiece toy may be attached to human hair, or two hairpiece toys of the above described construction may be attached to human hair in lefthand and right-hand positions.

The hairpiece toy constructed as above described is adapted such that the braid ornament hair portion 10 including a braid of artificial hairs is integrally coupled to the clip 22 which can be attached to and detached from human hair, providing a braid ornament to child's hair without difficulty only by attaching the clip 22 to the child's hair.

Additionally, the ribbon ornament portion 14, the heart-shaped ornament portion 18 and the floral pattern ornament portion 30 which are mounted to the braid ornament hair portion 10 allow more gorgeous and easy ornamentation.

The provision of the ribbon ornament portion 14 in a position corresponding to the clip 22 offers the advantage of making it difficult to recognize a boundary between human hair and the braid ornament hair portion 10.

The hairpiece toy according to a second preferred embodiment of the present invention is described below.

Figure 9:
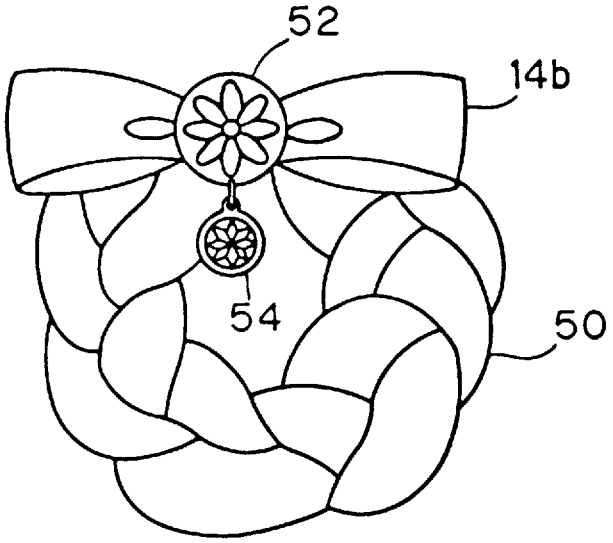
FIG. 9 is a front elevation of the hairpiece toy according to a second preferred embodiment of the present invention.
Figure 10:
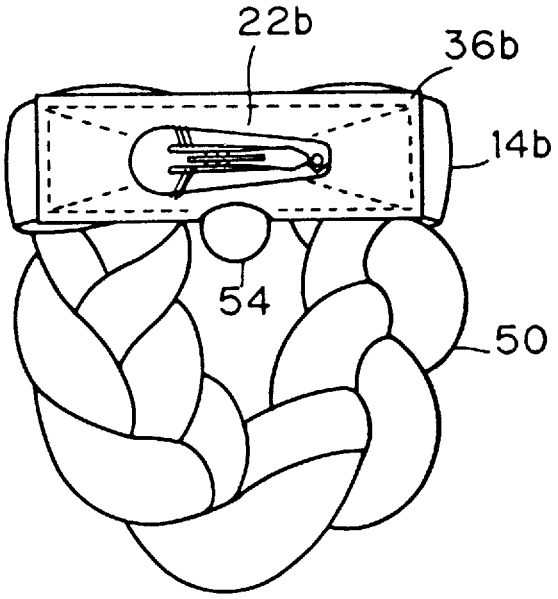
FIG. 10 is a rear elevation of the hairpiece toy according to the second preferred embodiment.

With reference to FIGS. 9 and 10, the hairpiece toy of the second preferred embodiment comprises a clip **22*b* similar in construction to the clip 22 of the first preferred embodiment and sewn on a backing cloth 36*b***.

A doughnut-shaped ornament hair portion 50 including a braid formed by plaiting three tufts of artificial hairs and having opposite ends connected together into a ring-shaped configuration is sewn at the connection on the front side of the backing cloth **36*b***.

A ribbon ornament portion **14*b* is sewn on the sewn part of the doughnut-shaped ornament hair portion 50. The ribbon ornament portion 14*b* includes a twin ring-shaped portion formed by sewing a ring-shaped ribbon of satin at circumferentially opposed positions together (see FIG. 5**), and a narrow band wound around the sewn part of the twin ring-shaped portion.

A first floral pattern ornament portion 52 having a surface embossed with a floral design is sewn on a front central part of the ribbon ornament portion **14*b*; and a second floral pattern ornament portion 54 having a surface embossed with a floral design is supported by and suspended from the first floral pattern ornament portion 52**.

Figure 11:
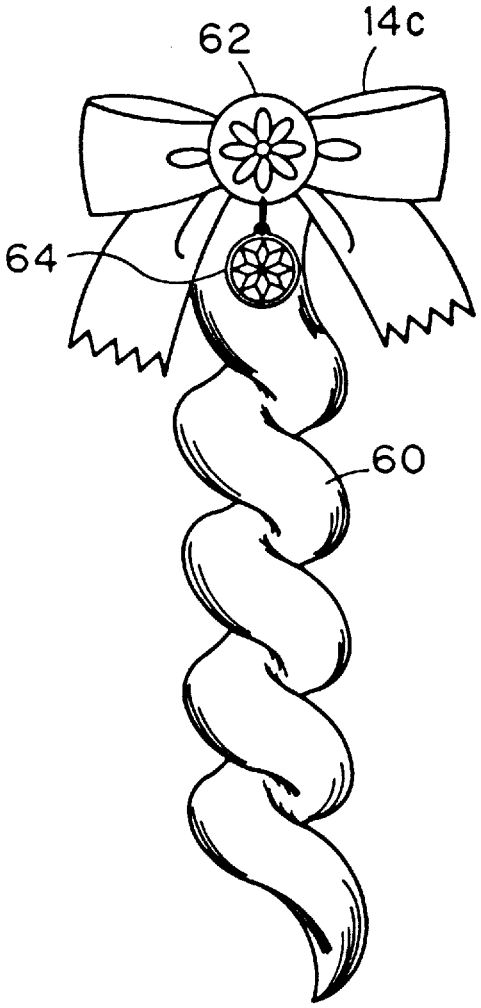
FIG. 11 is a front elevation of the hairpiece toy according to a third preferred embodiment of the present invention.
Figure 12:
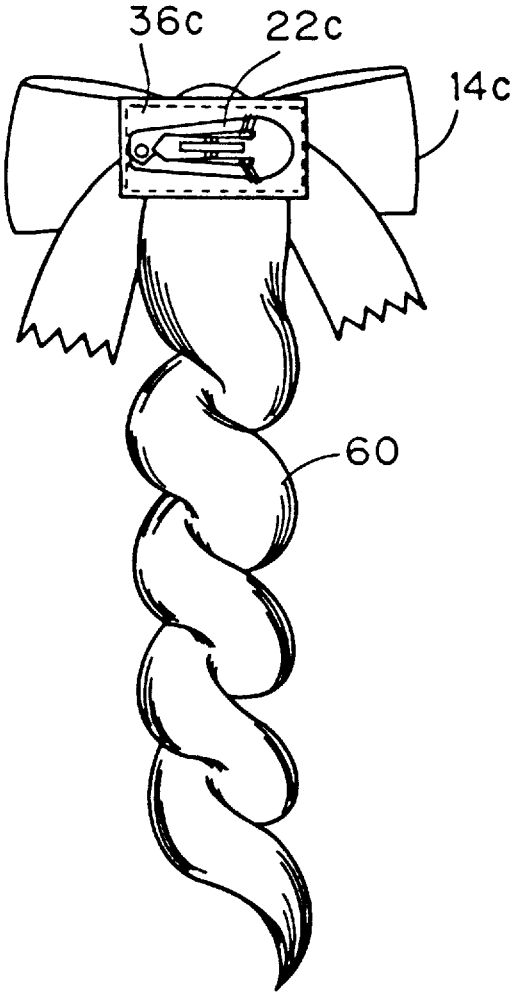
FIG. 12 is a rear elevation of the hairpiece toy according to the third preferred embodiment.

The hairpiece toy according to a third preferred embodiment of the present invention is discussed hereinafter with reference to FIGS. 11 and 12.

The hairpiece toy of the third preferred embodiment comprises a clip **22*c* similar in construction to the clip 22 shown in FIGS. 3 and 4 and sewn on a backing cloth 36*c***.

A curl ornament hair portion 60 including a tuft of artificial hairs curled in a spiral configuration is sewn on the surface of the backing cloth **36*c*, and a ribbon ornament portion 14*c* similar in construction to the ribbon ornament portion 14 shown in FIG. 7 is sewn on the front side of the curl ornament hair portion 60. A first floral pattern ornament portion 62 having a surface embossed with a floral design is sewn on a front central part of the ribbon ornament portion 14*c*, and a second floral pattern ornament portion 64 having a surface embossed with a floral design is supported by and suspended from the first floral pattern ornament portion 62**.

Figure 13:
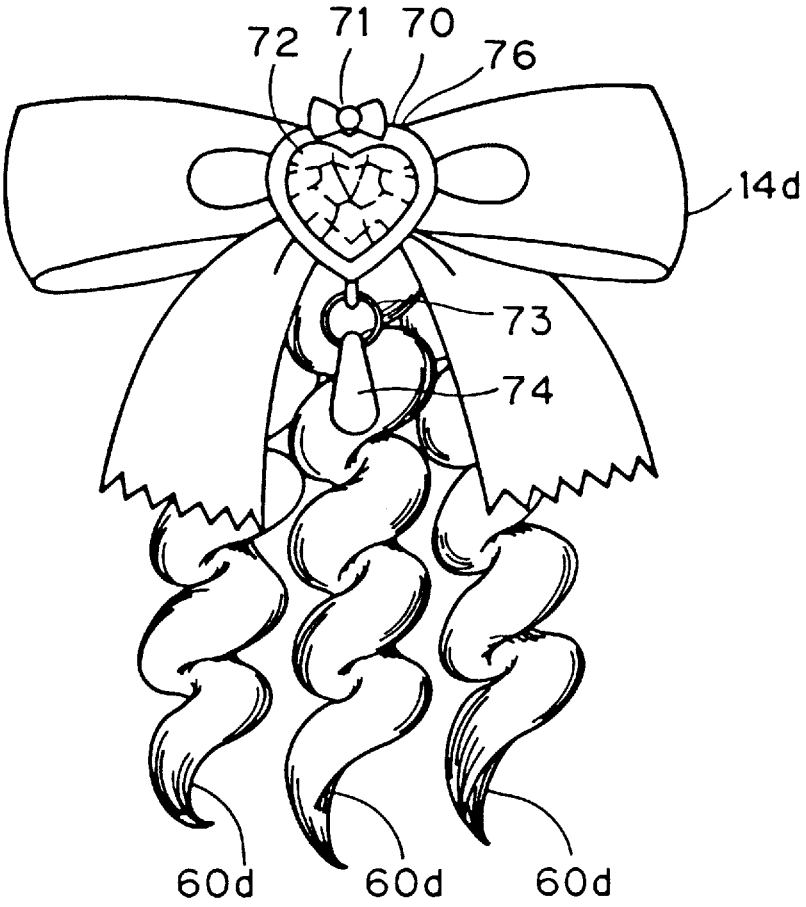
FIG. 13 is a front elevation of the hairpiece toy according to a fourth preferred embodiment of the present invention.
Figure 14:
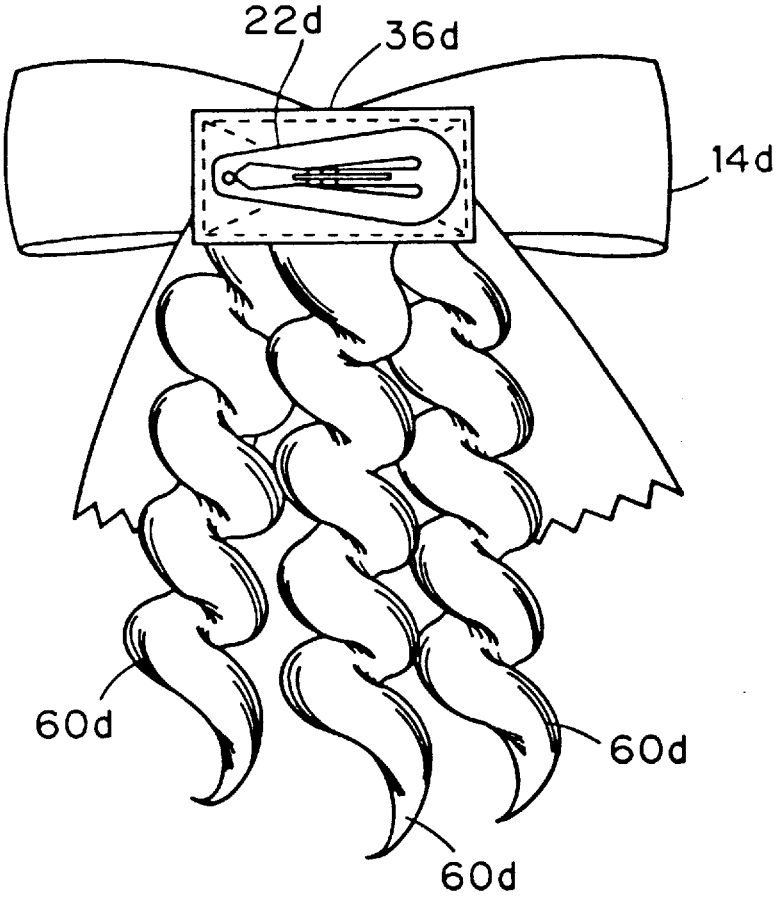
FIG. 14 is a rear elevation of the hairpiece toy according to the fourth preferred embodiment.

Finally, the hairpiece toy according to a fourth preferred embodiment of the present invention is discussed hereinafter with reference to FIGS. 13 and 14.

The hairpiece toy of the fourth preferred embodiment comprises a clip **22*d* similar in construction to the clip 22 shown in FIGS. 3 and 4 and sewn on a backing cloth 36*d***.

Three curl ornament hair portions **60*d* each including a tuft of artificial hairs curled in a spiral configuration are sewn on the surface of the backing cloth 36*d*, and a ribbon ornament portion 14*d* similar in construction to the ribbon ornament portion 14 shown in FIG. 7 is sewn on the upper front part of the curl ornament hair portions 60*d*. A heart-shaped ornament portion 76 is sewn on a front central part of the ribbon ornament portion 14*d*. The heart-shaped ornament portion 76 includes a gold-colored plated base portion 70, a butterfly-shaped formed portion 71 on an upper edge of the base portion 70, a heart-shaped colored imitation jewel 72 mounted on the base portion 70, and a teardrop-shaped imitation jewel 74 supported by and suspended from an annular member 73 suspended from the base portion 70**.

The hairpiece toy according to the second, third and fourth preferred embodiments constructed as above described is similar in effect to that of the first preferred embodiment.

Figure 15A:
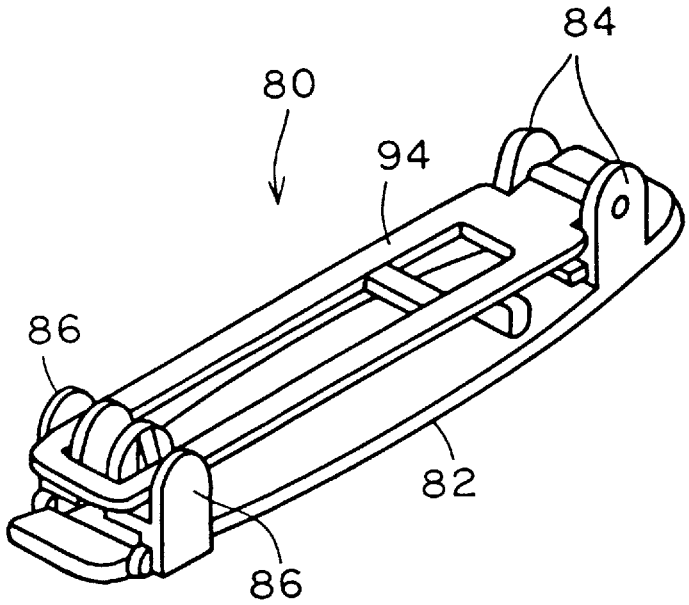
FIGS. 15A and 15B illustrate a barrette.
Figure 15B:
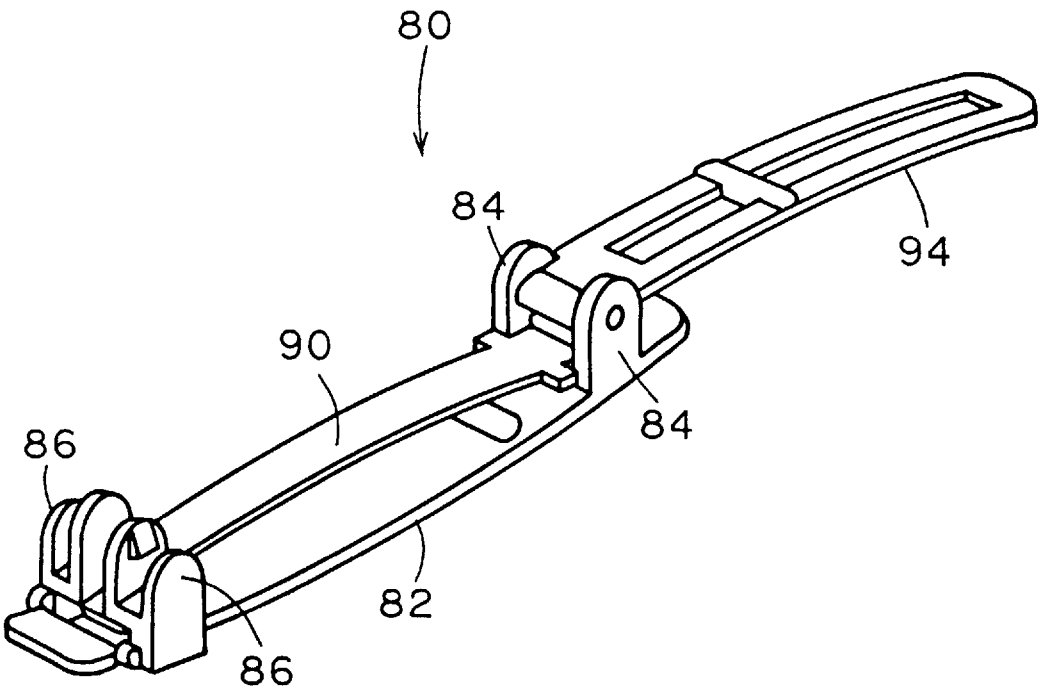

A barrette 80 shown in FIGS. 15A and 15B may be used in place of the above described clips 22, **22*b*, 22*c*, and 22*d***.

The barrette 80 comprises a base member 82 of a generally elongated plate-like configuration in plan view, a pair of pivot support members 84 mounted upright on one end of the base member 82, a movable member 94 having the shape of an elongated frame and pivotally supported at its proximal end by the pair of pivot support members 84, a pair of engagement support members 86 mounted upright on the other end of the base member 82 and removably engaged by a frame portion of the movable member 94 at its distal end, and a curved leaf spring 90 mounted between the pivot support members 84 and the engagement support members 86.

With a tuft of human hair inserted between the movable member 94 and the leaf spring 90, the forward end portion of the movable member 94 is brought into engagement with the engagement support members 86. The barrette 80 is then attached to the human hair. On the other hand, the barrette 80 may be removed from the human hair as the forward end portion of the movable member 94 is brought out of engagement with the engagement support members 86.

Rubber bands, other hair pins and clips, and the like may be used in place of the clips 22, 22*b*, 22*c*, and 22*d*, and the barrette 80.

While the invention has been described in detail, the foregoing description is in all aspects illustrative and not restrictive. It is understood that numerous other modifications and variations can be devised without departing from the scope of the invention.

I claim:

1. A hairpiece toy comprising:

a fastening for attachment to and removal from hair, said fastening having a portion adapted to be inserted through said hair to frictionally attach said fastening to said hair and having a periphery region defining a plurality of holes;

a backing cloth having a front side and a back side opposite said front side, said fastening being sewn to the back side of said backing cloth via said plurality of holes; and an ornament hair portion including ornamentally processed artificial hairs, said ornament hair portion being sewn to the front side of said backing cloth.

2. The hairpiece toy according to claim 1, further comprising a ribbon ornament portion attached to said ornament hair portion.

3. The hairpiece toy according to claim 2, wherein said ribbon ornament portion includes a ribbon formed in a butterfly-shaped configuration.

4. The hairpiece toy according to claim 2, wherein said ribbon ornament portion is positioned to cover said fastening.

5. The hairpiece toy according to claim 1, wherein said fastening is a clip.

6. The hairpiece toy according to claim 5, wherein said ornament hair portion comprises a braid of artificial hairs.

7. The hairpiece toy according to claim 5, wherein said ornament hair portion comprises a braid of artificial hairs formed in a doughnut-shaped configuration.

8. The hairpiece toy according to claim 5, wherein said ornament hair portion comprises a curled tuft of artificial hairs.

9. The hairpiece toy according to claim 1, wherein said fastening is a barrette.

10. The hairpiece toy according to claim 1, further comprising:

a formed ornament portion having a surface with an ornamental pattern and attached to an end of said ornament hair portion, wherein the formed ornament portion ties the ends of the ornament hair portion together.

* * * * *